US008137887B2

(12) United States Patent
Sheng et al.

(10) Patent No.: US 8,137,887 B2
(45) Date of Patent: Mar. 20, 2012

(54) PHOTOCONDUCTOR STRUCTURE PROCESSING METHODS AND IMAGING DEVICE PHOTOCONDUCTOR STRUCTURES

(75) Inventors: Xia Sheng, Los Altos, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1244 days.

(21) Appl. No.: 11/823,249

(22) Filed: Jun. 27, 2007

(65) Prior Publication Data

US 2009/0004588 A1 Jan. 1, 2009

(51) Int. Cl.
*G03G 13/24* (2006.01)

(52) U.S. Cl. ..... 430/123.43

(58) Field of Classification Search ..... 430/123.43
See application file for complete search history.

(56) References Cited

U.S. PATENT DOCUMENTS 3,830,648 A * 8/1974 Rutherford et al. ..... 430/67
6,040,106 A * 3/2000 Hori et al. ..... 430/127
6,451,493 B1 9/2002 Omokawa et al.
2004/0265715 A1 12/2004 Itami et al.
2004/0265716 A1 12/2004 Itami et al.
2005/0136349 A1* 6/2005 Mishra et al. ..... 430/58.05
2005/0158641 A1 7/2005 Yanagawa et al.
2005/0186494 A1 8/2005 Inagaki et al.
2007/0087278 A1 4/2007 Yamazaki

OTHER PUBLICATIONS

HPDC, "Photoconductor Structure Processing Methods and Imaging Device Photoconductor Structures", Internat'l Search Report for PCT/US2008/008038, filed Jun. 25, 2008. Report issued by Korean Intellectual Property Office, Jan. 12, 2009.

* cited by examiner

*Primary Examiner* — Thorl Chea

(57) ABSTRACT

Photoconductor structure processing methods and imaging device photoconductor structures are described. According to one embodiment, a photoconductor structure processing method includes processing a photoconductor structure of an imaging device and wherein the photoconductor structure comprises charge transport material configured to conduct electrical charges generated responsive to reception of light to form a latent image during an electro-photographic imaging process, the processing comprising removing at least some of the charge transport material from at least a portion of the photoconductor structure. The photoconductor structure may also be further treated to reduce the migration of charge transport material. Additional embodiments are described in the disclosure.

4 Claims, 2 Drawing Sheets

PHOTOCONDUCTOR STRUCTURE PROCESSING METHODS AND IMAGING DEVICE PHOTOCONDUCTOR STRUCTURES

FIELD OF THE DISCLOSURE

Aspects of the disclosure relate to photoconductor structure processing methods and imaging device photoconductor structures.

BACKGROUND OF THE DISCLOSURE

Imaging devices capable of printing images upon paper and other media are ubiquitous in black and white as well as color printing or reproduction applications. Laser printers and digital printing presses are but a few examples of imaging devices in wide use today for black and white or color imaging.

Electro-photographic imaging processes utilize a photoconductor which may be electrically charged and then selectively discharged to form latent images. The latent images may be developed and the developed images may be transferred to media to form hard images upon the media. Electro-photographic imaging processes may be implemented in various laser printer configurations and digital presses in illustrative examples.

The photoconductor may deteriorate over time which may result in reduced imaging quality. The photoconductor may be replaced but with increased cost of operating the imaging system. At least some embodiments of the disclosure are directed towards photoconductors having increased shelf life and service life and processing methods relative to photoconductors to provide increased shelf life and service life in some examples. Other aspects are also described in the disclosure.

SUMMARY

According to some aspects of the disclosure, photoconductor structure processing methods and imaging device photoconductor structures are described.

According to one embodiment, a photoconductor structure processing method comprises processing a photoconductor structure of an imaging device and wherein the photoconductor structure comprises charge transport material configured to conduct electrical charges generated responsive to reception of light to form a latent image during an electro-photographic imaging process, the processing comprising removing at least some of the charge transport material from at least a portion of the photoconductor structure.

According to another embodiment, an imaging device photoconductor structure comprises a charge transport structure comprising charge transport material configured to conduct electrical charges generated responsive to reception of light to form a latent image during use of the photoconductor structure in an electro-photographic imaging device, wherein one portion of the charge transport structure comprises less charge transport material than another portion of the charge transport structure.

Other embodiments are described as is apparent from the following discussion.

DETAILED DESCRIPTION

Aspects of the present disclosure are directed towards photoconductor structures and methods of processing photoconductor structures used in imaging processes. The methods and photoconductor structures have increased shelf life and service life which reduces the imaging costs compared with arrangements wherein service or replacement of photoconductor structures is performed at shorter intervals. In some example embodiments, the methods and photoconductor structures provide reduced migration of charge transport material to an imaging surface of the photoconductor structures which may otherwise lead to degradation of the photoconductor structures. Additional embodiments are described below.

Figure 1:
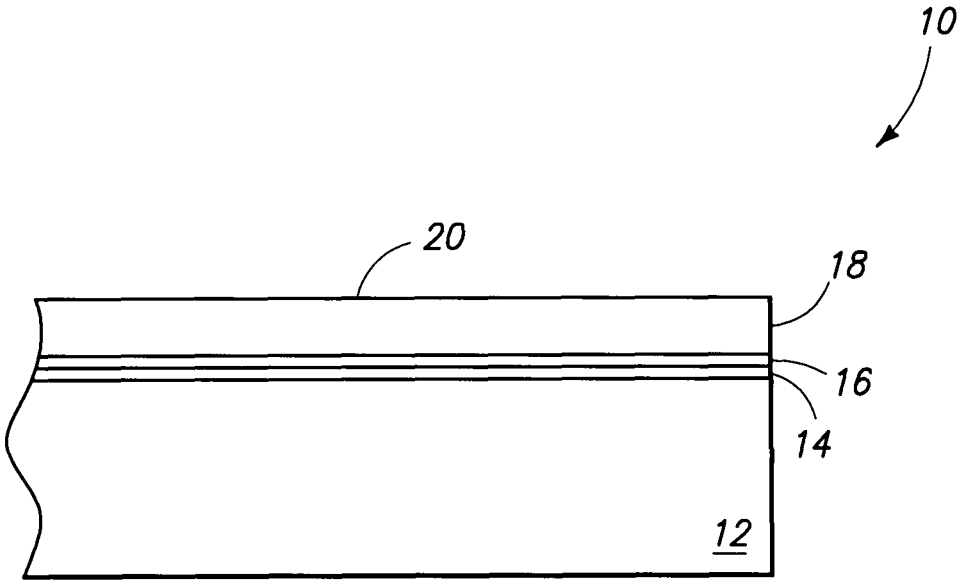
FIG. 1 is an illustrative representation of a photoconductor structure of an imaging device according to one embodiment.

Referring to FIG. 1, an example of a fragment of a photoconductor structure 10 is shown according to one embodiment. The depicted photoconductor structure 10 includes a substrate 12, an electrically conductive electrode 14, a charge generation structure 16 and a charge transport structure 18. Electrode 14 and structures 16, 18 may be formed or deposited as layers over substrate 12 in illustrative embodiments. Charge transport structure 18 may include an imaging surface 20 which is configured to receive a marking agent, such as a dry (e.g., toner) marking agent or liquid (e.g., ink particles in a carrier fluid) marking agent, thereover during development of images.

FIG. 1 is illustrative for discussion purposes of example embodiments of the disclosure and other configurations are possible. Photoconductor structure 10 may be implemented as a sheet which may be wrapped around a drum having surface 20 outwardly facing and provided in an imaging device (e.g., printer, digital press, copier, etc. not shown in FIG. 1) configured to implement electro-photographic imaging operations to form hard images upon media such as paper in one embodiment. For example, surface 20 may receive an electrical charge over substantially the entire surface and portions of the surface 20 may be selectively discharged to form latent images which may be subsequently developed and transferred to the media.

Substrate 12 is configured to support other materials of the photoconductor structure 10 in one embodiment. Substrate 12 may have a thickness of approximately 10-30 microns and may be formed of an electrically insulative plastic (e.g., polyimide) or other suitable material.

Electrically conductive electrode 14 may be provided over substrate and may be an aluminum back electrode in one configuration. Electrode 14 has a thickness of approximately 100 nm in one embodiment.

Charge generation structure 16 is provided over electrode 14. Charge generation structure 16 is sensitive to light in one embodiment and portions of structure 16 which receive light may generate charges corresponding to an image to be formed during imaging operations. Material of charge generation structure 16 may include organic pigments such as phthalocyanice, perylene, etc. The pigments may be mixed with binder materials and coated on electrode 14 to form the charge generation structure 16 in the form of a layer in one embodiment. In one embodiment, charge generation structure 16 has a thickness of approximately 1 micron.

A charge block layer (not shown) may be provided between charge generation structure 16 and the electrically conductive electrode 14 in one embodiment. The charge block layer may comprise electrically insulative material configured to reduce or prevent charge present in structure 16 from moving to electrode 14 in one example.

Charge transport structure 18 is provided over charge generation structure 16 and provides imaging surface 20 described above. Charge transport structure 18 may include an electrically insulative binder or backbone (e.g., a polymer such as polycarbonate) with electrically conductive charge transport material (e.g., molecules), also referred to as CTM, substantially uniformly dispersed and incorporated therein. Charge transport material is configured to conduct electrical charges (holes or electrons) within charge transport layer 18, for example, during photo-excitation operations of an electro-photographic imaging process. Charge transport structure 18 has a thickness of approximately 18 microns in one embodiment. Examples of charge transport material include biphenyl, triarylanime, and hydrazone molecules in some embodiments.

As mentioned above, photoconductor structure 10 may receive a static electrical charge during imaging operations of the imaging device in one embodiment. Portions of the imaging surface 20 having the static electrical charge may be selectively discharged by photo-excitation, for example, during an electro-photographic imaging process in one embodiment. For example, light (e.g., emitted by a laser writing system) may be used to selectively discharge charged portions of the imaging surface 20 to form latent images. Electrical charges may be generated in the charge generation structure 16 corresponding to portions of the photoconductor structure 10 receiving the emitted light in the photo-excitation process of the electro-photographic process. The electrical charges generated within structure 16 may be transported to imaging surface 20 using charge transport material of the charge transport structure 18. The transported electrical charges may be opposite in polarity to the static electrical charge provided at imaging surface 20 (e.g., imaging surface 20 may be negatively electrically charged and holes may be generated within structure 16 responsive to received light in one embodiment) and may accordingly discharge the desired portions of the electrostatic charge upon imaging surface 20 corresponding to the latent image to be formed. Charged toner may be attracted to the discharged portions of the imaging surface 20 to develop the latent images.

One of the possible mechanisms of degradation of the photoconductor structure 10 is a change of lateral electrical conductivity of the photoconductor structure 10 which affects local charging and discharging properties of the photoconductor structure 10. Another possible degradation mechanism is contamination on the imaging surface 20 which is difficult to clean during typical cleaning cycles. It is believed that both sources of degradation may be caused by the migration of the charge transport material to the imaging surface 20 during printing operations. For example, charge transport material may migrate to imaging surface 20 due to the presence of one or more of the charging electrical field, raise of temperature, and interaction of the photoconductor structure 10 with plasma generated by the charging system during the imaging process. The presence of migrated charge transport material on the imaging surface 20 may cause a change in lateral electrical conductivity of the imaging surface 20 which may result in a reduction of imaging resolution. In addition, migrated charge transport material at the imaging surface 20 may interact with materials of the marking agent and other media in contact with the imaging surface 20 which may result in a build-up of material at imaging surface 20. The buildup of material may adversely change the charging and discharging properties of the photoconductor structure 10. According to illustrative embodiments, photoconductor structures 10 and methods of processing photoconductor structures 10 to reduce migration of charge transport material to imaging surface 20 are described.

Figure 2:
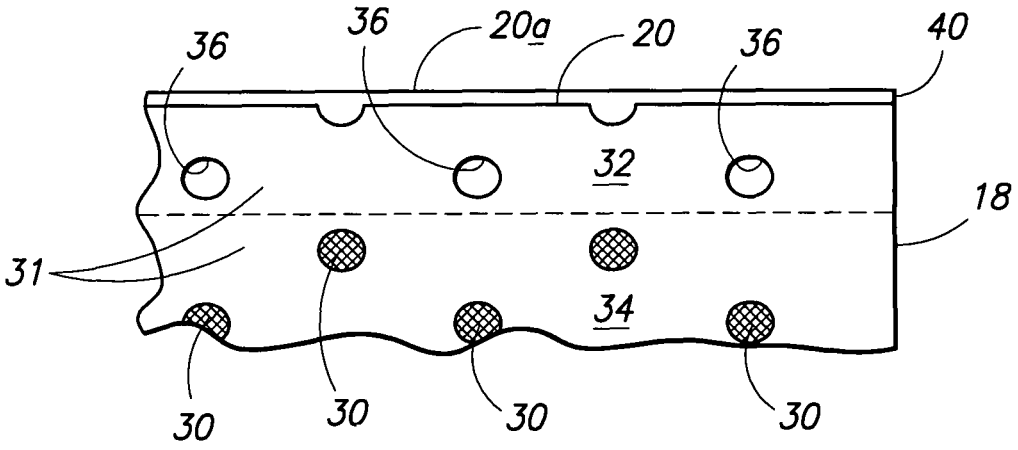
FIG. 2 is an illustrative representation of processing of a photoconductor structure of an imaging device according to one embodiment.

Referring to FIG. 2, illustrative embodiments for processing photoconductor structure 10 to reduce migration and accumulation of charge transport material at imaging surface 20 are described. A fragment of charge transport structure 18 including imaging surface 20 is shown in FIG. 2. In one embodiment, the processing includes removing at least some charge transport material from portions of charge transport structure 18.

For example, charge transport structure 18 may initially include charge transport material 30 substantially uniformly dispersed within a binder or backbone 31. Photoconductor 20 may be processed to remove at least some of the charge transport material 30 in one portion 32 (e.g., a first layer 32 of charge transport structure 18 adjacent to surface 20) of charge transport structure 18 while leaving remaining charge transport material 30 in another portion 34 (e.g., a second layer 34 of charge transport structure 18). In one more specific embodiment, substantially all of the charge transport material 30 is removed from the portion 32 (e.g., a first layer 32) of the charge transport structure 18 adjacent to imaging surface 20. In one example, portion 32 with charge transport material 30 removed may be a top layer (e.g., a first layer 32) adjacent to imaging surface 20 and have a thickness of approximately 1-50 nm in one embodiment. Areas of portion 32 (e.g., a first layer 32) wherein charge transport material 30 has been removed are shown as voids or pores 36 in the illustrated example. Accordingly, in one embodiment, charge transport structure 18 includes one portion 32 (e.g., a first layer 32) having less charge transport material 30 than another portion 34 (e.g., a second layer 34). In such examples, charge transport structure 18 has first and second charge transport layers 32, 34, wherein the first layer 32 of the charge transport structure 18 comprises less charge transport material than the second layer 34 of the charge transport structure 18. In some such examples, the first layer 32 comprises a porous layer 32 of electrically insulative material substantially void of the charge transport material 30. See FIG. 2 showing first and second layers 32, 34.

Backbone 31 of charge transport structure 18 may be organic material, for example, comprising polycarbonate in the embodiment described above. A suitable organic solvent (e.g., propylene carbonate, hexane, methyl isobutyl ketone (MIBK) or other) may be used in one embodiment to remove charge transport material 30 from portion 32 of charge transport structure 18. For example, the solvent may be used to dissolve the charge transport material 30 from portion 32 while the backbone 31 remains in both portions 32, 34 of structure 18 during and after the processing to remove the charge transport material 30 from portion 32. In one embodiment, substantially all of the charge transport material remains in portion 34 during and after the processing to remove the charge transport material from portion 32. Accordingly, the charge transport material 30 may be partially or completely removed in some embodiments.

In one example processing method, the portion 32 of charge transport structure 18 may be immersed in the solvent to remove the charge transport material 30 from portion 32.

In another example processing method, imaging surface 20 is wiped with the solvent for example using a cloth or sponge soaked with the solvent followed by spray cleaning, for example using isopropyl alcohol.

In yet another example, portion 32 may be sprayed with the solvent to remove the charge transport material 30 from portion 32, followed by spray cleaning, for example using isopropyl alcohol.

The thickness of portion 32 of charge transport structure 18 from which charge transport material 30 is removed corresponds to the length of treatment using the solvent in one embodiment. For example, the treatment may be performed for approximately 2-60 minutes by immersing in propylene carbonate to remove the charge transport material 30 within portion 32 which has a thickness of 1-50 nm in one embodiment.

Following the solvent treatment, the photoconductor structure 10 may be cleaned using another solvent (e.g., isopropanol alcohol), water or other suitable material for the photoconductor structure 10 to remove the initial solvent and dissolved charge transport material.

The above-described methods are examples and other methods may be used to remove the charge transport material 30 from portion 32 of charge transport structure 18 in other embodiments. Portion 32 of charge transport structure 18 is porous (e.g., in the form of a porous layer of charge transport structure 18 in the described embodiment) with pores 36 having dimensions of approximately 1-10 nm corresponding to the removed charge transport material 30 (e.g., voids in the organic backbone matrix 31) in one embodiment. The photoconductor structure 10 having portion 32 of reduced charge transport material provides reduced migration of charge transport material in charge transport structure 18 to imaging surface 20 (and reduce accumulation of charge transport material at imaging surface 20) compared with constructions wherein charge transport material is uniformly provided in the entirety of structure 18.

The removal of the charge transport material may be referred to as initial processing to reduce migration of charge transport material to imaging surface 20. In one embodiment, photoconductor structure 10 having charge transport material 30 removed from portion 32 of charge transport structure 18 may be additionally or subsequently processed to further reduce migration of charge transport material within portion 32 of charge transport structure 18 compared with migration of charge transport material within charge transport structure 18 without such processing. Additional or subsequent processing to further reduce the migration of charge transport material in portion 32 reduces accumulation of charge transport material 30 (e.g., from portion 34) at imaging surface 20 in one embodiment.

In one example, photoconductor structure 10 may be processed by converting porous portion 32 into a compact layer to reduce the migration of charge transport material 30. In one embodiment, imaging surface 20 of photoconductor structure 10 may be exposed to a thermal treatment at a temperature close to or above the glass transition temperature of the backbone 31. The thermal treatment operates to reshape the porous portion 32 into a compact layer. Pressure may be applied to the imaging surface 20 of photoconductor structure 10 during the thermal treatment to form the compact layer in one embodiment. In one example, porous portion 32 having a thickness of approximately 20 nm may be compacted into the compact layer having a thickness of approximately 10 nm. The reduction of thickness of porous portion 32 improves the discharging process at the imaging surface 20 in one embodiment.

In addition, photoconductor structure 10 may be mounted in one embodiment on a cylinder during the thermal treatment. The cylinder may have a diameter which corresponds to a diameter of a photoconductor drum of the imaging device to provide similar stresses during the thermal treatment as when the photoconductor structure is implemented in the imaging device.

Another approach of subsequently processing portion 32 includes exposure of portion 32 to a chemical treatment including controlled dissolution and reformation of portion 32. For example, a roller or a sponge loaded with a chemical, such as toluene or acetone to dissolve the material of portion 32, could be controlled to contact portion 32 to provide controlled removal of porous material of portion 32 and compacting of portion 32.

In another example, the photoconductor structure 10 may be processed by filling pores 36 with filler material to reduce migration of charge transport material in structure 18 and accumulation thereof at imaging surface 20. In one embodiment, pores 36 may be filled with the filler material comprising electrically insulative material such as inorganic molecules or inorganic nanoparticles. For example, 1-3 nm pores 36 may be filled with filler material including molecules of less than 1 nm or nanoparticles having dimensions of 1-2 nm to reduce migration of the charge transport material in portion 32 of structure 18. Filling of the pores 36 may be achieved by a wet coating process (e.g., dip coating or roller coating) or a dry process (e.g., vacuum evaporation or chemical vapor deposition) in illustrative examples. In one example, the pores are filled by CVD deposition of a material such as a parylene polymer at room temperature and a pressure of around 0.1 torr.

In an additional embodiment, an electrically insulative coating 40 may be formed over imaging surface 20 and portion 32 of charge transport structure 18 to reduce accumulation of charge transport material 30 at an imaging surface 20*a*. In one embodiment, the material of coating 40 may be the same as or different from the backbone 31 of the charge transport structure 18. In one embodiment, coating 40 may be achieved by a wet coating process (e.g., dip coating or roller coating) or a dry process (e.g., vacuum evaporation or chemical vapor deposition) to form a layer in illustrative examples. Pores 36 may act as anchors to ensure good adhesion of coating 40 to charge transport structure 18 in one embodiment.

Coating 40 may be a layer having an appropriate thickness of approximately 1-20 nm to permit photoconductor structure 10 to discharge to form latent images. In addition, the material of coating 40 may be selected such that the electrical and optical functions of the photoconductor structure 10 are not substantially affected. For example, when using wet processing to form coating 40, a solvent for the coating material is selected to not dissolve other material of the photoconductor structure 10. Furthermore, the material of coating 40 may be selected to resist materials involved in the imaging process (e.g., including the marking agents and cleaning agents) and the surface tension of the coating 40 should be similar to the photoconductor structure 10. Material of coating 40 may be selected to provide adhesion to the charge transport structure 18, be scratch resistant, and be electrically insulative and transparent in one embodiment.

In one embodiment, material of coating 40 may be alcohol soluble polymers (e.g., polyvinylpyridine and polyvinylpyrrolidone and their block or random copolymers with other vinyl or acrylic monomers and polyvinylbutyral-co-vinyl alcohol-co-vinyl acetate with varying degrees of vinylbutyral, vinyl alcohol, and vinyl acetate units). These polymer materials may be applied by dip coating or roller coating to form coating 40. Coating 40 in the form of a Langmuir-Blodgett monolayer film may be deposited by dip coating.

In another example of material of coating 40, alcohol soluble polymers may be prepared with hydroxyethyl methacrylate or acrylate as one of the components. Mixing these polymers with isocyanates or epoxy components yield a relatively clear solution in alcohol. Upon coating by one of the methods, cross-linking can be effected at room temperature for several hours or at elevated temperature (60-80 C.) for a shorter period of time (few minutes to hours), or through UV radiation for a relatively short period of time (less than 1 minute).

In another example, cross-linkable material with relatively low viscosity (e.g., <50 cP) can be coated by dip coating or roller coating, and then cross linked by UV or thermal treatment. Examples of these materials include acrylic or polyimide precursors with photo or thermal initiators, or a combination of them. Cross-linked polymers can also be prepared with urethane based pre-polymers. These materials have relatively strong film strength and can be cured with diamines or diols at moderate temperatures, such as 70-80 C.

In addition, inorganic nanoparticles such as silica or alumina can be incorporated in the above first and second example organic materials of coating 40 to enhance the hardness of coating 40 and to improve the scratch resistance of the photoconductor structure 10. Organic and inorganic materials may be deposited on photoconductor structure 10 by dry processes such as CVD, thermal deposition, or sputter deposition which permit a great selection of materials compared with wet coating processes. As one example, coating 40 comprising a perylene thin film can be deposited at relatively low temperature and with low cost.

The additional processing of photoconductor 18 following the removal of the charge transport material 30 may be beneficial to further reduce migration of charge transport material 30 through structure 18 (e.g., via pores 36 of portion 32) and further reduce accumulation of material 30 at imaging surface 20 over time and which may improve the shelf life of photoconductor structure 10. In addition, the additional processing may increase the structural integrity of photoconductor structure 10.

One or more of the above-illustrated examples of the additional processing of the photoconductor 18 including thermal treatment, filling of pores 36 and applying coating 40 may be performed for a given photoconductor 10. Also, although such processing is referred to as additional or subsequent processing after the initial processing to remove charge transport material 30 from portion 32, it is to be understood that such additional processing may also be performed in other embodiments independently and in the absence of the initial processing to remove the charge transport material 32 from portion 30. Likewise, it is to be understood that the initial processing to remove the charge transport material 18 from portion 32 may be performed alone or in combination with the additional (or subsequent) processing described above in example embodiments. The initial and subsequent processing individually reduce migration of charge transport material (and reduce accumulation of the charge transport material at the imaging surface 20) although increased reduction of the migration of the charge transport material is provided by both the initial and subsequent processings in combination compared with the reduction provided by an individual one of the initial or subsequent processings without the other.

Figure 3:
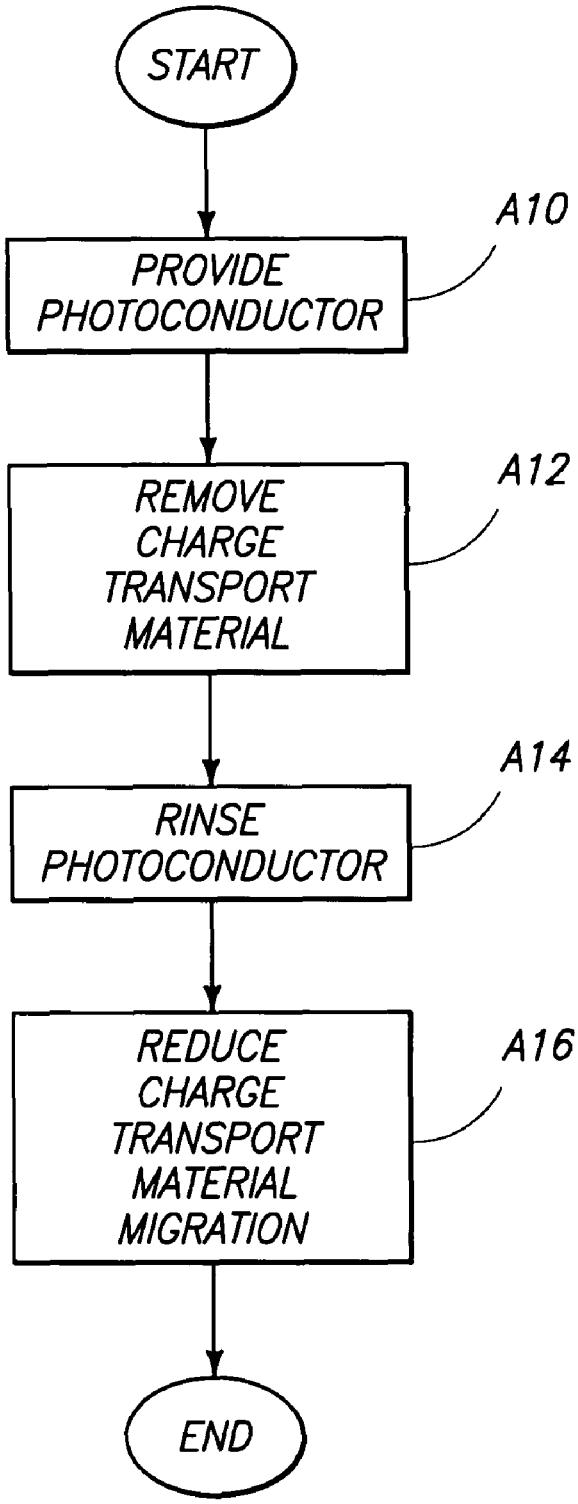
FIG. 3 is a flow chart of a method for processing a photoconductor structure of an imaging device according to one embodiment.

Referring to FIG. 3, one method of processing photoconductor structure 10 is shown. Other methods are possible including more, less or alternative acts.

At an act A10, a photoconductor structure, for example, having a substrate, backing electrode, charge generation structure and charge transport structure is formed or otherwise provided.

At an act A12, the photoconductor structure is initially processed, for example using a solvent, to remove charge transport material from a portion of the photoconductor adjacent to the imaging surface of the photoconductor structure. The removal of the charge transport material may form a porous layer at the imaging surface.

At an act A14, a solvent, if used at act A12, and dissolved charge transport material may be rinsed from the photoconductor structure.

At an Act A16, the portion of the photoconductor substantially void of the charge transport material may be subsequently processed to further reduce migration of charge transport material in structure 18 and accumulation thereof at imaging surface 20. For example, the portion of the photoconductor structure substantially void of the charge transport material may be exposed to a thermal treatment, filled with electrically insulative filler material, or coated with an electrically insulative substantially transparent coating material as described above.

The processing of the photoconductor structure 10 according to example embodiments of the disclosure including initial processing to remove charge transport material from a portion of structure 10 and subsequent processing of the photoconductor structure 10 individually reduce migration or diffusion of charge transport material within the charge transport structure 18 and accumulation thereof at surface 20 which is believed to result in photoconductor structures 10 of increased shelf and service lives. The processing reduces degradation of photoconductor structure 10 caused by changing of lateral electrical conductivity due to building up of charge transport material on the imaging surface of the photoconductor structure 10 in one example.

Aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative acts than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. An imaging device photoconductor structure comprising:

a charge transport structure comprising first and second charge transport layers to conduct electrical charges generated responsive to reception of light to form a latent image during use of the imaging device photoconductor structure in an electro-photographic imaging device, wherein the first layer of the charge transport structure comprises less charge transport material than the second layer of the charge transport structure, the first layer comprising a porous layer of electrically insulative material substantially void of the charge transport material.

2. The structure of claim 1, further comprising electrically insulative filler material in voids of the porous layer.

3. The structure of claim 1 wherein the first layer is adjacent to an imaging surface of the imaging device photoconductor structure, the image surface to receive a developing agent to develop the latent image.

4. The structure of claim 1 further comprising a second layer of electrically insulative material adjacent to the first layer, a surface of the second layer of electrically insulative material being an imaging surface of the imaging device photoconductor structure.

* * * * *